US005572747A

United States Patent [19]

Cheng

[11] Patent Number: 5,572,747

[45] Date of Patent: Nov. 12, 1996

[54] BELT AND BUCKLE ASSEMBLY

[76] Inventor: Juei-Hsiang Cheng, No. 3, Alley 71, Lane 484, Chin Hua Road, Sec. 1, Tainan, Taiwan

[21] Appl. No.: 515,308

[22] Filed: Aug. 15, 1995

[51] Int. Cl.[6] ..... A41F 9/00

[52] U.S. Cl. ..... 2/322; 2/312; 24/585

[58] Field of Search ..... 2/322, 321, 311, 2/336, 338, 312; 24/585, 170, 191, 180

[56] References Cited

U.S. PATENT DOCUMENTS 3,466,668 9/1969 Ochiai ..... 2/322
4,229,862 10/1980 Kubelka ..... 24/170

FOREIGN PATENT DOCUMENTS 2454363 5/1975 Germany ..... 24/585
2454854 5/1975 Germany ..... 24/585

*Primary Examiner*—C. D. Crowder
*Assistant Examiner*—Gloria Hale
*Attorney, Agent, or Firm*—Pro-Techtor International

[57] ABSTRACT

A belt and buckle assembly in which the clamping plate which is turned about a transverse pivot pin at one end of the buckle has two perpendicular teeth and is supported on a torsional spring; the belt has two longitudinal series of sloping teeth and a plurality of longitudinal rows of spaces alternatively disposed at a back side thereof near the tail; the teeth of the clamping plate allow the sloping teeth of the belt to pass forward and stop them from backward movement; the belt is released from the buckle when the clamping plate is moved downward to compress the torsional spring and to shift the teeth into the longitudinal rows of spaces.

2 Claims, 2 Drawing Sheets

BELT AND BUCKLE ASSEMBLY

BACKGROUND OF THE INVENTION

The present invention relates to a belt and buckle assembly which can be conveniently adjusted subject to the size of the object to which it is fastened.

Regular belt and buckle assemblies are commonly comprised of a buckle, a belt having a lead end fixed to the buckle and a tail end made with a longitudinal series of locating holes, and a holding-down plate turned about a transverse pivot pin at one end of the buckle and having a locating rod for insertion into one locating hole of the tail of the belt. This structure of belt and buckle assembly cannot be adjusted to the desired tension because the adjustment must be made step by step by shifting the locating rod of the holding-down plate from one locating hole to another. FIG. 1 shows another structure of belt and buckle assembly according to the prior art which comprises a buckle 10, a handle 20 having one end pivoted to the buckle 10 and made with a tooth 30, and a belt 40 having a lead end fixed to the buckle 10 and a tail end made with a longitudinal series of teeth 50. When the tail end of the belt 40 is inserted into the buckle 10, the handle 70 is turned downwards to force the tooth 30 into engagement with the teeth 50 of the belt 40. The handle 70 has two opposite raised portions (not shown) bilaterally disposed on the inside. When the handle 70 is moved to the holding down position, the raised portions of the handle 70 are forced into engagement with respective recessed portions 60 on the buckle 10, and therefore the handle 70 is retained in the holding down position. This structure of belt and buckle assembly is still not satisfactory in function. After long uses, the engagement between the raised portions of the handle 70 and the recessed portions 60 of the buckle 10 become unstable, and the handle 30 tends to slip out of the holding down position.

SUMMARY OF THE INVENTION

The present invention has been accomplished to provide a belt and buckle assembly which eliminates the aforesaid drawbacks. It is one object of the present invention to provide a belt and buckle assembly which can be conveniently adjusted to the desired tension subject to the size of the object being fastened. It is another object of the present invention to provide a belt and buckle assembly which can be firmly secured in the position when the belt is fastened up. According to the preferred embodiment of the present invention, the clamping plate which is turned about a transverse pivot pin at one end of the buckle has two perpendicular teeth and is supported on a torsional spring; the belt has two longitudinal series of sloping teeth and a plurality of longitudinal rows of spaces alternatively disposed at a back side thereof near the tail. The teeth of the clamping plate allow the sloping teeth of the belt to pass forward and stop them from backward movement. The belt is released from the buckle when the clamping plate is moved downward to compress the torsional spring and to shift the teeth into the longitudinal rows of spaces.

DETAILED DESCRIPTION OF THE PREFERRED EMBODIMENT

Figure 1:
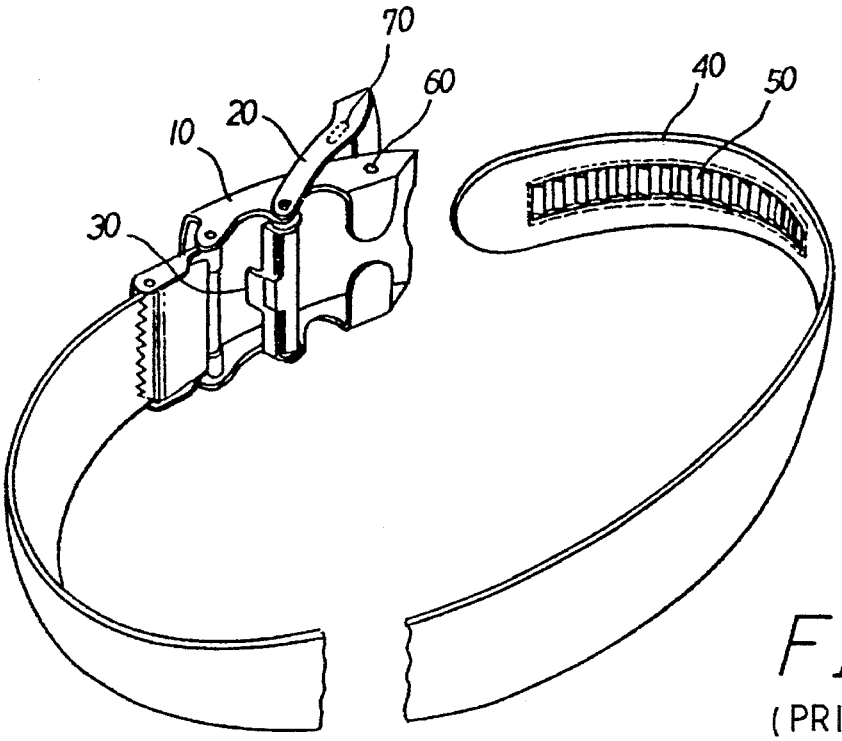
FIG.1 (PRIOR ART)
FIG. 1 shows a belt and buckle assembly according to the prior art.
Figure 2:
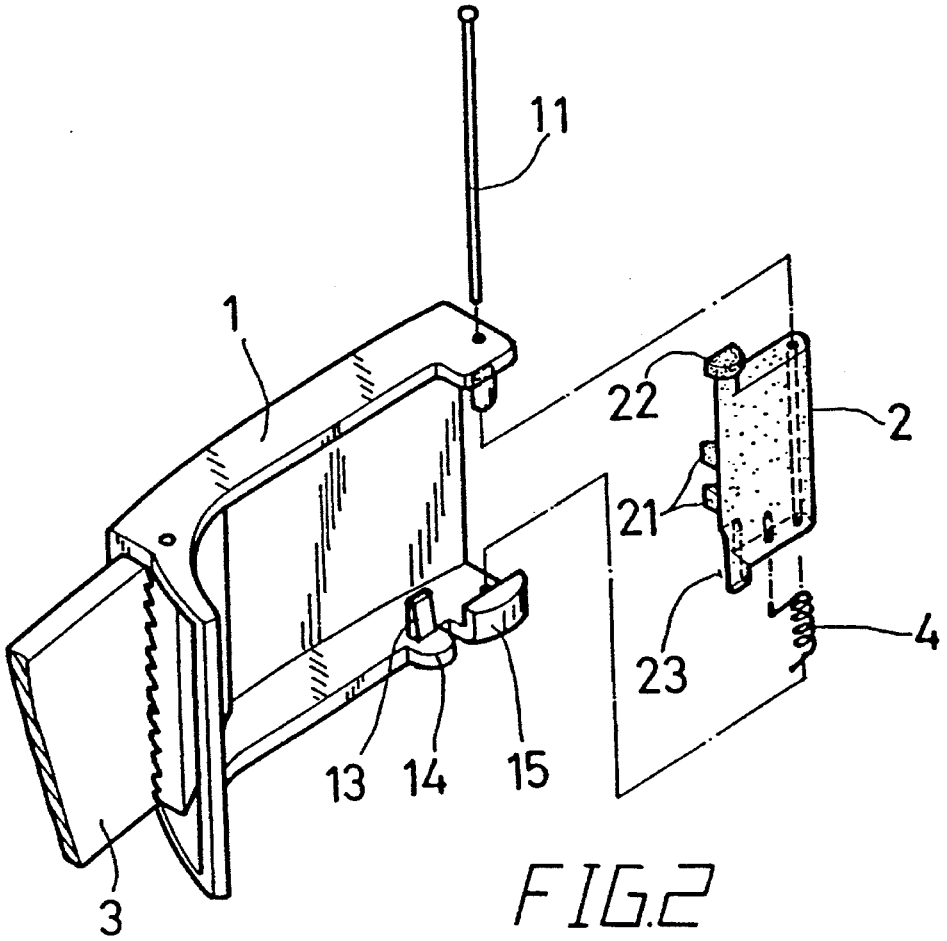
FIG. 2 is an exploded view of a buckle according to the present invention.
Figure 3:
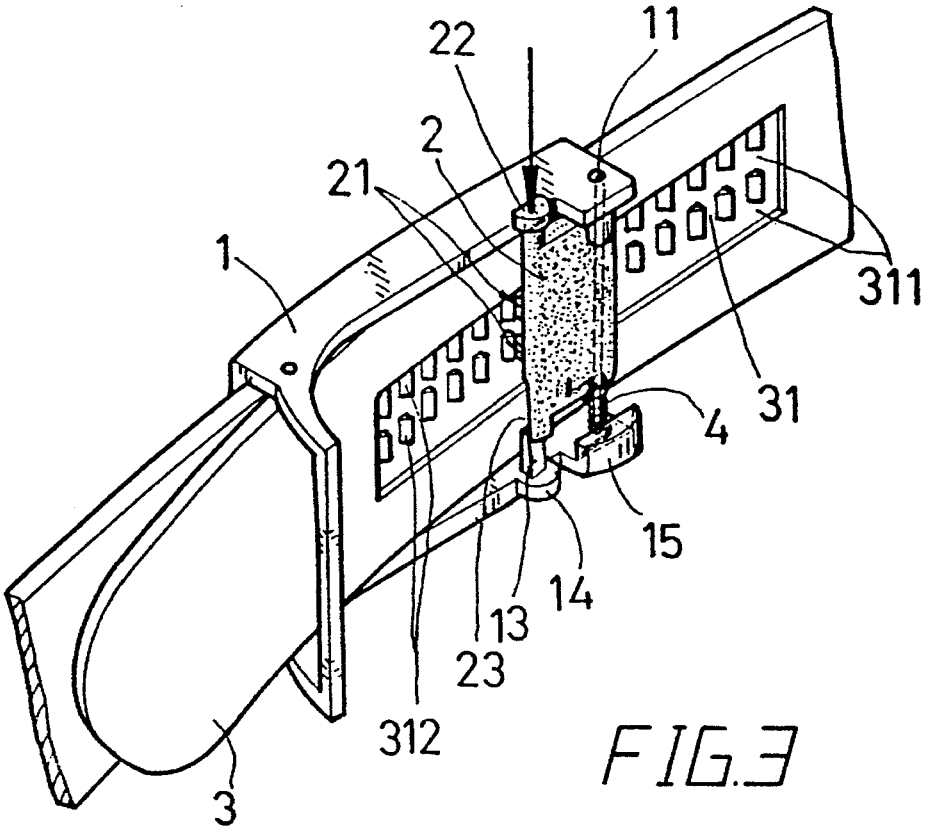
FIG. 3 is an installed view showing the two opposite ends of the belt joined by the buckle according to the present invention.

Referring to FIGS. 2 and 3, the buckle 1 which is fastened to one end (the lead end) of the belt 3 comprises a pivot pin 11 transversely disposed at one end, an inward flange 15 at an outer side relative to the pivot pin 11, a bevel block 13 and a stop rod 14 disposed at right angles adjacent to the pivot pin 11. A clamping plate 2 is turned about the pivot pin 11 and controlled to hold down the opposite end (the tail) of the belt 3, having two teeth 21 perpendicularly disposed at one side in the middle remote from the pivot pin 11, a finger strip 22 and a bevel block 23 at two opposite sides relative to the teeth 21. The bevel block 23 of the clamping plate 2 matches with the bevel block 13 of the buckle 1. A torsional spring 4 is mounted around the pivot pin 11 and stopped between the clamping plate 2 and the inward flange 15, having one end fastened to the clamping plate 2 and an opposite end fastened to the inward flange 15 of the buckle 1. The belt 3 comprises a longitudinal recess 31 at the back side near the tail, and two longitudinal series of sloping teeth 312 raised from the longitudinal recess 31 and sloping in one direction and defining with the longitudinal recess 31 longitudinal rows of spaces 311.

Figure 4:
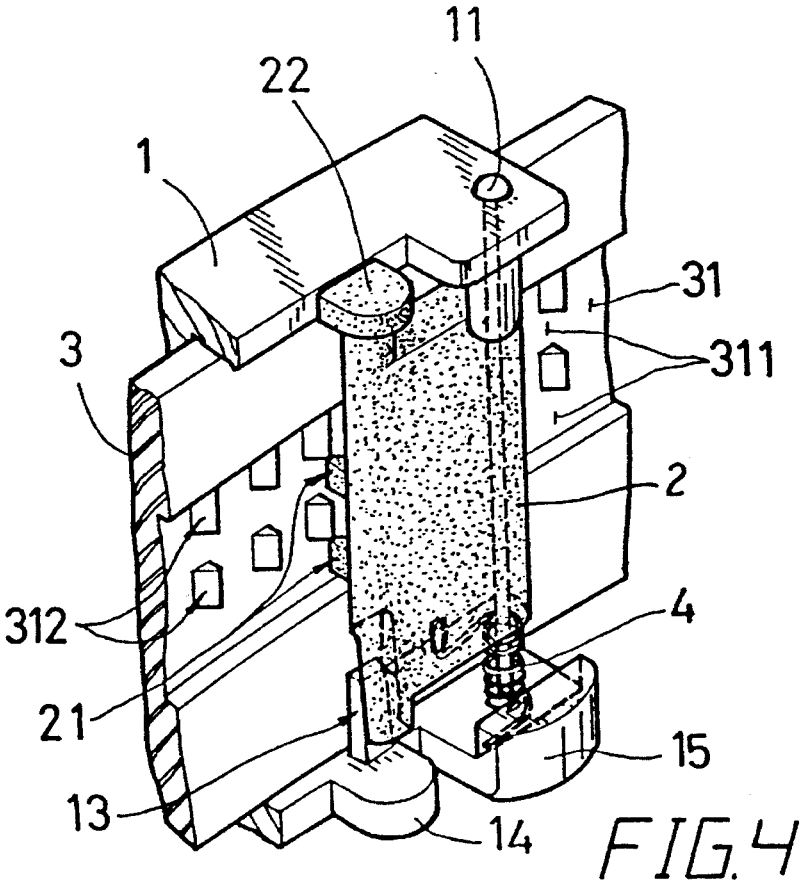
FIG. 4 is a partial view in an enlarged scale of FIG. 3 but showing the buckle released.

Referring to FIGS. 3 and 4, because the clamping plate 2 is turned about the pivot pin 11 and supported on the torsional spring 4, when the tail of the belt 3 is inserted in between the buckle 1 and the clamping plate 2, the teeth 21 of the clamping plate 2 are forced outwards by the sloping teeth 312 of the belt 3 for permitting the tail of the belt 3 to be moved forwards. When the tail of the belt 3 is released from the hand, the teeth 21 of the clamping plate 2 are forced by the torsional spring 4 into engagement with the two longitudinal series of sloping teeth 312 of the belt 3, and therefore the tail of the belt 3 is held down (see FIG. 3). When the clamping plate 2 is moved downward by hand through the finger strip 22 to compress the torsional spring 4, the bevel block 23 of the clamping plate 2 is moved along the bevel block 13 of the buckle 1 and stopped at the stop rod 14, and the teeth 21 of the clamping plate 2 are disengaged from the longitudinal series of sloping teeth 312 of the belt 3 and moved into the longitudinal series of spaces 311, and therefore the tail of the belt 3 is released from the constraint of the clamping plate 2 and can be released from the buckle 1.

It is to be understood that the drawings are designed for purposes of illustration only, and are not intended as a definition of the limits and scope of the invention disclosed.

I claim:

1. A belt and buckle assembly comprising:

a belt having a lead end and a tail end, and a buckle having one end fixed to the lead end of said belt and an opposite end mounted with a transverse pivot pin, said buckle comprises a clamping plate turned about said transverse pivot pin to hold down the tail end of said belt as it is inserted between said buckle and said clamping plate, said buckle further comprises an inward flange at an outer side relative to said transverse pivot pin, a guide block means and a stop rod disposed at right angles adjacent to said transverse pivot pin, said stop rod limiting downward movement of said clamping plate; and said belt comprises two longitudinal series of sloping teeth and a plurality of longitudinal rows of spaces alternatively disposed at a back side thereof near the tail; said clamping plate is supported on a torsional spring, having two teeth perpendicularly disposed at a first side remote from said transverse pivot pin for engagement with the sloping teeth of said belt, a belt guide block means corresponding to the guide block means of said buckle, and a finger strip opposite the guide block means of said clamping plate on which a user exerts force to move said clamping plate downward against said torsional spring to shift the teeth of said clamping plate from the sloping teeth of said belt to the plurality of longitudinal rows of spaces of said belt, said torsional spring having on end fastened to said clamping plate and an opposite end fastened to said inward flange of said buckle.

2. The belt and buckle assembly of claim 1 wherein the guide block means of said buckle and said clamping plate are bevel blocks.

* * * * *